US010981126B2

(12) United States Patent
Brothier et al.

(10) Patent No.: US 10,981,126 B2
(45) Date of Patent: Apr. 20, 2021

(54) DEVICE FOR MIXING POWDERS BY CRYOGENIC FLUID

(71) Applicant: COMMISSARIAT À L'ÉNERGIE ATOMIQUE ET AUX ÉNERGIES ALTERNATIVES, Paris (FR)

(72) Inventors: Méryl Brothier, Aix en Provence (FR); Stéphane Vaudez, Avignon (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 351 days.

(21) Appl. No.: 15/772,340

(22) PCT Filed: Nov. 3, 2016

(86) PCT No.: PCT/EP2016/076506
§ 371 (c)(1),
(2) Date: Apr. 30, 2018

(87) PCT Pub. No.: WO2017/076944
PCT Pub. Date: May 11, 2017

(65) Prior Publication Data

US 2018/0318778 A1 Nov. 8, 2018

(30) Foreign Application Priority Data

Nov. 4, 2015 (FR) ..... 15 60570

(51) Int. Cl.
*B01F 3/12* (2006.01)
*B01F 3/18* (2006.01)
(Continued)

(52) U.S. Cl.
CPC ..... *B01F 3/186* (2013.01); *B01F 3/1207* (2013.01); *B01F 3/1221* (2013.01);
(Continued)

(58) Field of Classification Search
None
See application file for complete search history.

(56) References Cited

U.S. PATENT DOCUMENTS 2,609,150 A * 9/1952 Bludeau ..... B29B 13/10 241/15
3,774,855 A * 11/1973 Wolf ..... B02C 17/14 241/65
(Continued)

FOREIGN PATENT DOCUMENTS

CA 2882302 A1 2/2014
CN 103611457 A 3/2014
(Continued)

OTHER PUBLICATIONS

International Search Report for PCT/EP2016/076506 dated Feb. 10, 2017.
(Continued)

*Primary Examiner* — Jennifer A Leung
(74) *Attorney, Agent, or Firm* — Pearne & Gordon LLP

(57) ABSTRACT

A device for mixing powders by cryogenic fluid, characterised in that it comprises at least: a chamber for mixing powders, comprising a cryogenic fluid; a chamber for supplying powders in order to allow the powders to be introduced into the mixing chamber; means for agitation in the mixing chamber so as to allow the mixing of the powders placed in suspension in the cryogenic fluid.

21 Claims, 5 Drawing Sheets

(51) Int. Cl.

| | |
|---|---|
| ***B01F 3/20*** | (2006.01) |
| ***B01F 7/02*** | (2006.01) |
| ***B01F 7/16*** | (2006.01) |
| ***B01F 11/02*** | (2006.01) |
| ***B01F 5/06*** | (2006.01) |
| ***B01F 7/00*** | (2006.01) |
| ***B01F 13/10*** | (2006.01) |
| ***B01F 13/00*** | (2006.01) |
| ***B01F 15/02*** | (2006.01) |

(52) U.S. Cl.
CPC ..... *B01F 3/1242* (2013.01); *B01F 3/18* (2013.01); *B01F 3/188* (2013.01); *B01F 3/2035* (2013.01); *B01F 5/0693* (2013.01); *B01F 7/00633* (2013.01); *B01F 7/021* (2013.01); *B01F 7/16* (2013.01); *B01F 11/0225* (2013.01); *B01F 11/0266* (2013.01); *B01F 13/0005* (2013.01); *B01F 13/1016* (2013.01); *B01F 15/0293* (2013.01); *B01F 2003/1278* (2013.01); *B01F 2013/1052* (2013.01); *B01F 2215/0095* (2013.01)

(56) References Cited

U.S. PATENT DOCUMENTS

| | | | | |
|---|---|---|---|---|
| 4,034,966 | A * | 7/1977 | Suh | B01F 3/18 366/183.1 |
| 4,156,593 | A * | 5/1979 | Tarpley, Jr. | B01F 11/0216 44/624 |
| 4,428,535 | A | 1/1984 | Venetucci | |
| 4,721,256 | A * | 1/1988 | Lyman | B02C 23/24 241/1 |
| 4,917,834 | A | 4/1990 | Hadermann | |
| 9,358,548 | B2 * | 6/2016 | Barthelmess | B02C 21/00 |
| 2017/0345521 | A1 | 11/2017 | Vaudez | |
| 2017/0358376 | A1 | 12/2017 | Benedetti et al. | |

FOREIGN PATENT DOCUMENTS

| | | | |
|---|---|---|---|
| EP | 0117708 | A2 | 5/1984 |
| EP | 0920921 | A2 | 6/1999 |
| EP | 1864710 | A1 | 12/2007 |
| JP | H04-503471 | A | 6/1992 |
| JP | 2011-206677 | A | 10/2011 |
| WO | 9910092 | A1 | 3/1999 |
| WO | 20060111266 | A1 | 10/2006 |

OTHER PUBLICATIONS

Written Opinion for PCT/EP2016/07506 dated Feb. 10, 2017.
Preliminary French Search Report for FR 1560570 dated Sep. 8, 2016.
D. Geldart, "Types of Gas Fluidization", in: Powder Technology, 1973, vol. 7, pp. 285-292.
Office action for Chinese patent application No. 201680064416.7 dated Aug. 11, 2020.
English translation of the Jul. 15, 2020 Office action for CN application No. 2018-522568.

* cited by examiner

DEVICE FOR MIXING POWDERS BY CRYOGENIC FLUID

This is a National Stage application of PCT international application PCT/EP2016/076506, filed on Nov. 3, 2016 which claims the priority of French Patent Application No. 1560570, filed Nov. 4, 2015, both of which are incorporated herein by reference in their entirety.

TECHNICAL FIELD

This invention relates to the field of preparing granular mediums, and more precisely to the mixing of powders, in particular of actinide powders, and to the deagglomeration/reagglomeration thereof in order to obtain a mixture of high homogeneity through a cryogenic fluid, also called a cryogenic media.

In a privileged manner, it applies to high density and/or cohesive powders, such as actinide powders. The invention as such preferably has application for the mixing of actinide powders allowing for the formation of nuclear fuel, in particular pellets of nuclear fuel.

The invention as such proposes a device for mixing powders by a cryogenic fluid, as well as an associated method for mixing powders.

Prior Art

Implementing different steps for preparing a granular medium, in particular from actinide powders in order to form pellets of nuclear fuel after forming by pressing, is essential as it substantially conditions the control of the microstructure of the final produce but also the presence or not of macroscopic aspect defects within a fuel pellet. In particular, the mixture of actinide powders in order to allow for the production of nuclear fuel constitutes a key step in the controlling of the quality of the fuel pellet obtained, which most often is subjected to compliance with strict requirements in terms of microstructure and impurities.

The industrial, conventional and historical method of powder metallurgy applied to the elaboration of nuclear fuel is based on steps of mixing, grinding and/or granulation, all carried out dry. Indeed, implementing liquid in the nuclear industry induces the generation of effluents that can be difficult to treat. Also, for the preparing of a granular medium for the purpose of elaborating nuclear fuel, procedures are not conventionally used other than those that use the dry method.

In order to carry out the mixing of powders, various devices are known in prior art, which can be broken down according to the families described hereinafter.

First of all, there is the principle of the dry phase mixer without internal media. This can in particular be a mixer of the Turbula® type from the company WAB which through movements that are more or less complex of the tank containing the powders to be mixed, allows for a more or less substantial homogenisation of the granular medium. Generally, the effectiveness of this type of mixture is limited. Indeed, according to the type of powders to be mixed, heterogeneous zones can subsist, for which the mixture does not take place or in the least incorrectly and inadmissibly. The kinematics of this type of mixture is generally not complex enough to induce a pushed mixture, i.e. a mixture that is satisfying in terms of homogeneity, without a pushed development itself or a mixing duration that is penalising at the industrial level. Moreover, the energy transmitted to the granular medium in this type of mixer does not make it possible to carry out deagglomeration that is sufficient to reach sufficient degrees of homogeneity in the case where the size of these agglomerates is excessive (in particular to be offset during the step of sintering).

The principle of the media mixture is also known. According to this principle and in order to favour the operation of mixing, one or several mobile facilities can be used within the tank containing the powder to be mixed. These mobile facilities can be blades, turbines, coulters, ribbons, endless screws, among others. In order to improve the mixing, the tank can itself be mobile. This type of mixer can be more effective than the preceding category but still remains insufficient and suffers from limitations. Indeed, the mixing induces a modification in the granular medium via agglomeration or a deagglomeration that is difficult to control, which induces an overrunning of powders and/or a degradation in the flowability of the granular medium. Moreover, the use of mobile facilities (media) for mixing results in pollutions (contaminations) when it concerns mixing abrasive powders such as those that have to be implemented to produce nuclear fuel. In addition, the mobile facilities implemented induce retentions which generate flow rates of doses that have a substantial impact in the case of elaborating nuclear fuel.

There is also the principle of the mixer of the grinder type. Indeed, according to the usage mode and the type of technology of certain grinders, it is possible to produce mixtures of powders via co-grinding. This type of operation makes it possible to obtain a satisfactory mixture, from a homogeneity standpoint, but requires a relatively long grinding time, typically several hours, and also induces grinding phenomena that reduce the size of the particles of powders. This causes the generation of fine particles and a modification in the specific surface which also affects the possibility of using the powders later after the mixing thereof (modification in flowability, reactivity (possible oxidation), sinterability of the powders, etc.). In the framework of manufacturing nuclear fuel, the operation of co-grinding, by generating fine particles causes a non-negligible radiological impact, due to the retention and the propensity of the fine particles to disperse. Moreover, clogging phenomena can be induced.

After using these various types of mixers, it is often necessary to carry out an agglomeration or granulation. In addition, these devices are generally discontinuous, which can be an issue in industrial methods.

Generally, the aforementioned mixers are not fully satisfactory for mixing certain powders, such as actinide powders, and it is necessary to follow this with a step of granulation in order to obtain a flowable granular medium.

Other mixtures are also known, implementing a multiphase medium, namely fluid-solid phases. These mixers can be classified into two main categories described hereinafter.

First of all, there are mixers of the liquid/solid type. These mixes do not work for the implementing of powders soluble with the liquid phase used in the mixer or if the powders are modified by the contact with the fluid. Moreover, for powders that have a high density compared to the liquid introduced into the mixer, the mixture is most often not effective or requires substantial agitation speeds. Indeed, the pulling-off speed of a particle from the bottom of the agitator is directly linked to the difference in density between the particles constituting the powders and that of the liquid allowing for the placing in suspension. In this case, viscous liquids can be used but this induces an increased energy demand, and this proportionately to the increase in viscosity before reaching a turbulent regime to favour the mixing.

Moreover, in this case of the mixer of the liquid/solid type, there is also the question of the separation of the liquid phase and of the solid phase after mixing. In the case of the mixture of actinide powders, this type of mixture would induce contaminated effluents that are very complicated to retreat, which is prohibitive. Furthermore, in practice, complete and homogeneous placing in suspension cannot be achieved when powders of a low granulometry are to be mixed. More precisely, in order to achieve optimum homogenisation, the so-called Archimedes dimensionless number must be greater than 10 (i.e. the forces of viscosities are less than the forces of gravity and inertia). Knowing that the particles that constitute powders to be mixed have relatively low diameters, typically less than 10 μm, it cannot be considered to produce homogenous and complete suspensions with this type of device without using additional means of mixing. In that respect, technologies, such as that described in patent application CA 2 882 302 A1, have been proposed but nevertheless remain inoperable for an application for mixing actinide powders, the means of vibration used do not allow for sufficient homogenisation with regards to the homogenisation objectives to be achieved and the particularities of actinide powders. In addition, for reasons of controlling criticality, the volume of the mixer has to be limited, in order to prevent any risk of double loading which could induce an exceeding of the permissible critical mass. Indeed, in a conventional liquid/solid mixer, the density of particles per volume of tank cannot be substantial, unless either exceeding an excessive agitation power, or undergoing a mixture kinetics that is too slow.

Finally note that mixers of powders in liquid phase, in particular of the type of those described in patent applications CA 2 882 302 A1, WO 2006/0111266 A1 and WO 1999/010092 A1, are not suited for the problem of a mixture of powders of the actinide powder type, because they would require excessively high agitation speeds to hope to pull off the powders from the bottom of the agitation tank and achieve levels of homogeneity that are in accordance with those sought in the nuclear industry. In addition, once again, they would induce contaminated effluents, difficult to manage industrially but also risks of criticality, even of radiolysis of the liquid phase used due to the fact of the nature of the powders to be implemented (beyond the fact that the latter can interact chemically with the liquid used).

Then, there are also mixers of the gas/solid type. This type of mixer can be operable and does not induce any risk of criticality. However, this type of mixer is hardly operable for powders that do not have sufficient fluidisation properties, conventionally C– type powders according to the classification of D. Geldart such as described in the publication Powder Technology, Vol. 7, 1973. However, this characteristic of poor fluidisation is encountered for cohesive actinide powders such as those implemented for manufacturing nuclear fuel. Moreover, beyond the difficulty in terms of fluidisation, with regards to the densities of the powders to be fluidised for the mixture, the superficial speed of the gas should be substantial and at least equal to the minimum speed of fluidisation. Also, this type of mixer appears hardly suitable for the mixing of cohesive powders and a fortiori with high density.

DISCLOSURE OF THE INVENTION

There is therefore a need to propose a new type of device for mixing powders for the preparation of granular mediums, and in particular for the mixing of actinide powders.

In particular, there is a need to be able at the same time to:

- deagglomerate the powders to be mixed without necessarily modifying the specific surface thereof and generate fine particles,
- mix the powders with a level of homogeneity that is sufficient to obtain a mixture of powders that meets the specifications, in particular in terms of homogeneity (i.e. making it possible in particular to obtain a representative elementary volume (REV) within the granular medium of about a few cubic micrometres to about 10 $\mu m^3$),
- not induce any pollution of the powders to be mixed, or modification in the surface chemistry, or generate liquid effluents that are difficult to treat,
- not induce any risk of specific criticality,
- not induce any risk of specific radiolysis,
- not induce any heating of the powders to be mixed,
- rely on a mixer with a limited diameter for controlling the risk of criticality even in the case of a loading error of the mixer,
- carry out the operation of mixing by limiting as much as possible the energy expended and this in a relatively short time with respect to the other mixers, i.e. about a few minutes compared to a few hours (for other mixing systems such as ball mills), for the same quantity of material to be mixed,
- have a continuous or practically continuous method of mixing.

The invention has for purpose to overcome at least partially the needs mentioned hereinabove and the disadvantages pertaining to embodiments of prior art.

The invention has for object, according to one of its aspects, a device for mixing powders, in particular of actinide powders, by a cryogenic fluid, characterised in that it comprises at least:

- a chamber for mixing the powders, comprising a cryogenic fluid,
- a chamber for supplying powders in order to allow the powders to be introduced into the mixing chamber,
- means for agitation in the mixing chamber so as to allow the mixing of the powders placed in suspension in the cryogenic fluid.

Note that, usually, a cryogenic fluid here designates a liquefied gas retained in liquid state at low temperature. This liquefied gas is chemically inert in the conditions for implementing the invention, for the powders to be mixed and deagglomerated.

The device for mixing powders according to the invention can furthermore comprise one or several of the following characteristics taken individually or according to any technically possible combinations.

The cryogenic fluid can comprise a slightly hydrogenated liquid, which is a liquid comprising at most one hydrogen atom per molecule of liquid, having a boiling temperature less than that of water.

According to a first embodiment of the invention, the device can comprise means for mixing of the mixing chamber according to a movement of the gyroscopic type.

In particular, the means for mixing according to a movement of the gyroscopic type can allow for the putting into motion, even the rotation, of the mixing chamber according to the three axes of three-dimensional metrology. This type of agitation via gyroscopic movement can in particular make it possible to favour the mixing of powders when they have high densities compared to the density of the fluid phase of the cryogenic fluid located in the mixing chamber.

According to a second embodiment of the invention, the device can comprise:

a plurality of mixing chambers of the powders, arranged successively in series one after the other, the chamber for supplying powders allowing for the introduction of powders into at least the first mixing chamber, a plurality of systems for restricting the passage of the powders, with each system for restricting the passage being located between two successive mixing chambers, in order to constrain the distribution of powders from one mixing chamber to the next.

Each mixing chamber can then comprise a cryogenic fluid, being in particular filled with a cryogenic fluid, and means for agitation, being in particular provided with means of agitation, so as to allow the mixing of the powders placed in suspension in the cryogenic fluid.

Moreover, the means of agitation can comprise mobile mixing facilities, in particular blades, turbines and/or mobile facilities with a duvet effect, among others.

These mobile mixing facilities can comprise grinding facilities, for example of the ball, roller type, among others.

In addition, the means of agitation can also comprise means for generating vibrations, in particular ultrasonic vibrations, in particular sonotrodes.

Furthermore, the systems for restricting the passage can comprise screens. The systems for restricting the passage can further comprise diaphragms.

The systems for restricting the passage can be adjusted and configured so that their section of passage is decreasing according to the flow of the powders through the plurality of mixing chambers, the section of passage of an (n−1)th system for restricting the passage being as such greater than the section of passage of an nth system of restricting the passage by following the flow of the powders.

In addition, the section of passage of the systems for restricting the passage can be less than the natural section of flow of the powders, in such a way that these powders are necessarily deagglomerated when they pass from one mixing chamber to the other. As such, the residence time of the particles to be mixed is intrinsically sufficient to allow for deagglomeration.

Moreover, the plurality of mixing chambers and the plurality of the systems for restricting the passage of the powders can advantageously be arranged according to the same vertical direction in such a way as to allow for a flow of the powders under the effect of gravity.

In addition, the device preferably comprises a system of electrostatic charge of the powders intended to be introduced into the mixing chamber or chambers.

A portion of the powders can in particular be placed in contact with a portion of the electrostatic charge system in order to be positively electrostatically charged and the other portion of the powders can be placed in contact with the other portion of the electrostatic charge system in order to be negatively electrostatically charged, in order to allow for a differentiated local agglomeration. In case of mixture of more than two types of powders, certain powders can be either positively charged, or negatively charged, or without charge.

The cryogenic fluid can moreover be of any type, being in particular liquefied nitrogen or argon. Note that the use of nitrogen is pertinent due to its low price but also due to the fact that the glove boxes and the methods implemented for the elaboration of the nuclear fuel with a plutonium base are inerted with nitrogen and the liquid nitrogen is itself used in certain operations on the fuel (BET measurement, etc.). The usage of this type of cryogenic fluid therefore does not induce any particular additional risk in the method of elaboration.

The device can very particularly comprise at least two chamber for supplying powders, and in particular as many chambers for supplying powders as there are types of powders to be fixed.

The chamber or chambers for supplying can comprise hoppers with adjustable supply and/or systems of the metering type, in particular vibrating plates or tunnels.

Furthermore, the invention further has for object, according to another of its aspects, a method for mixing powders, in particular of actinide powders, by a cryogenic fluid, characterised in that it is implemented by means of a device such as defined hereinabove, and in that it comprises the following steps:

a) introduction of powders intended to be mixed into the mixing chamber or chambers through the chamber or chambers for supplying, b) mixing of the powders in the mixing chamber or chambers, placed in suspension in a cryogenic fluid, through means for agitation, c) obtaining of a mixture formed from powders.

During the first step a), the powders can advantageously be electrostatically charged differently, in particular oppositely in the presence of at least two types of powders, in order to favour differentiated local agglomeration.

According to a first embodiment of the method, the device can comprise a single mixing chamber, and said mixing chamber can be moved by a movement of the gyroscopic type in order to allow for the mixing of the powders.

According to a second embodiment of the method, the device can comprise a plurality of mixing chambers of the powders, arranged successively in series one after the other, the chamber or chambers for supplying with powders allowing for the introduction of powders into at least the first mixing chamber, and a plurality of systems for restricting the passage of the powders, with each system for restricting the passage being located between two successive mixing chambers, in order to constrain the distribution of powders from one mixing chamber to the next, with each mixing chamber comprising a cryogenic fluid and means for agitation so as to allow the mixing of the powders placed in suspension in the cryogenic fluid, the method then being able to comprise the step consisting in progressively restraining the passage of the flow of the powders through the mixing chambers through systems for restricting the passage with a decreasing section of passage according to the flow of the powders.

The device and the method for mixing powders according to the invention can comprise any of the characteristics mentioned in the description, taken individually or according to any technically possible combinations with other characteristics.

BRIEF DESCRIPTION OF THE DRAWINGS

The invention can be better understood when reading the following detailed description, of non-limiting embodiments of the latter, as well as examining the figures, diagrammatical and partial, of the annexed drawing, wherein.

In all of these figures, identical references can designate identical or similar elements.

In addition, the various portions shown in the figures are not necessarily shown according to a uniform scale, in order to render the figures more legible.

DETAILED DESCRIPTION OF PARTICULAR EMBODIMENTS

Note that in the embodiments described hereinafter, the powders P considered are actinide powders that allow for the manufacture of pellets of nuclear fuel. In addition, the cryogenic fluid considered here is liquefied nitrogen. However, the invention is not limited to these choices.

Figure 1:
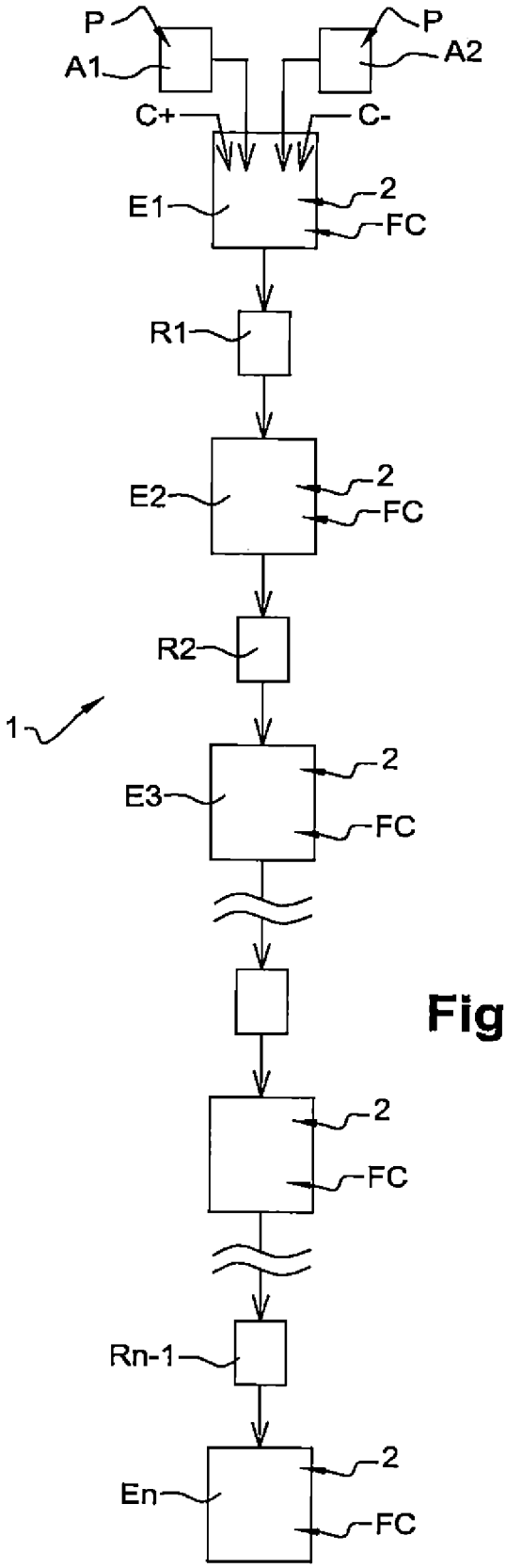
FIG. 1 shows a diagram illustrating the general principle of a device for mixing powders by a cryogenic fluid according to a first embodiment of the invention, FIG. 2 diagrammatically shows the agglomeration of particles of powders charged oppositely prior to the introduction thereof into mixing chambers of a device in accordance with the principle of FIG. 1, FIGS. 3 and 4 respectively show two examples of devices in accordance with the first embodiment of the invention, FIGS. 5A, 5B and 5C diagrammatically show alternative embodiments of mobile mixing facilities of devices of FIGS. 3 and 4, FIGS. 6 and 7 graphically show examples of changes in the mixing of powders of a device in accordance with the invention as a function of time.

In reference to FIG. 1, a diagram is shown illustrating the general principle of a device 1 for mixing powders P by a cryogenic fluid according to a first embodiment of the invention.

According to this principle, the device 1 comprises a number n of mixing chambers E1, . . . , En of the powders P, arranged successively in series one after the other according to the same vertical direction in such a way that the powders can circulate through the mixing chambers E1, . . . , En under the effect of the force of gravity. Moreover, the device 1 comprises a number n−1 of systems for restricting the passage R1, . . . , Rn−1 of the powders P, with each system for restricting the passage R1, . . . , Rn−1 being located between two successive mixing chambers E1, . . . , En, in order to constrain the distribution of powders P from one mixing chamber E1, . . . , En to the next. Examples of such systems for restricting the passage R1, . . . , Rn−1 are shown in what follows in reference in particular to FIGS. 3 and 4.

In addition, the device 1 also comprises two chambers A1 and A2 for supplying powders P, provided in particular for distributing powders of different types.

The two chambers A1 and A2 for supplying powders P allows for the introduction of the powders P into the first mixing chamber E1 in contact with the cryogenic fluid FC of the first chamber E1. Then the powders P successively pass through the systems for restricting the passage R1, . . . , Rn−1 and the mixing chambers E2, . . . , En, with each mixing chamber comprising a cryogenic fluid FC.

In addition, each mixing chamber E1, . . . , En comprises means for agitation 2 allowing for the mixing of powders P placed in suspension in the cryogenic fluid FC. Examples of such means of agitation 2 are provided in what follows in reference in particular to FIGS. 3 and 4.

The two chamber for supplying A1 and A2 comprise for example hoppers with adjustable supply, using for example an endless screw, and/or systems of the metering type, in particular vibrating plates or tunnels.

Furthermore, advantageously, the device 1 further comprises an electrostatic charge system C+, C− of the powders P introduced into the mixing chambers E1, . . . , En.

In particular, the portion of the powders P contained in the first chamber for supplying A1 is put into contact with the positive portion C+ of the electrostatic charge system in order to be positively electrostatically charged, while the portion of the powders P contained in the second chamber for supplying A2 is put into contact with the negative portion C− of the electrostatic charge system in order to be negatively electrostatically charged.

Figure 2:
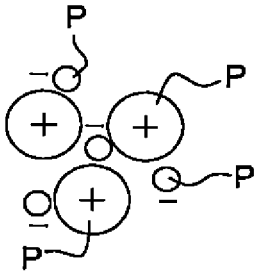

In this way, it is possible to allow for a differentiated local agglomeration, in other words prevent self-agglomeration. As shown in FIG. 2, which diagrammatically shows the agglomeration of particles of powders P charged oppositely prior to the introduction thereof into the mixing chambers E1, . . . , En, with the particles of the two powders P to be mixed being of an opposite electrostatic charge, a possible reagglomeration will occur mostly through the interposing of powders with a nature, and therefore charge, that are different. This as such makes it possible to favour mixing on the scale of the particles that comprise the powders P to be mixed.

The invention as such makes use of various technical effects that make it possible in particular to achieve the desired level of homogenisation, such as those described hereinafter:

- the improved deagglomeration, at least partial, of the powders P when the latter are placed in suspension in the cryogenic liquid FC,
- the improvement of the wettability of the powders P by using the liquefied gas constituted by the cryogenic fluid FC, which is a liquid with a low surface tension, compared to water, with the latter being used advantageously without using any additive that is difficult to eliminate,
- the agitation close to the regime of a perfectly agitated reactor implemented by the movement of the means for agitation, able or not able to use the placing in vibration of the suspension as described in what follows, with these vibrations then being advantageously unsteady in order to limit the heterogeneous zones.

In reference now to FIGS. 3 and 4, two examples of devices 1 in accordance with the first embodiment of the invention are diagrammatically shown, of which the principle has been described hereinabove in reference to FIG. 1.

In each one of these two examples, the device 1 comprises, in addition to the elements described hereinabove in reference to FIG. 1, an agitation motor 5 able to drive in rotation first means of agitation 2*a* having the form of mobile mixing facilities 2*a* in the mixing chambers E1, . . . , En.

These mobile mixing facilities 2*a* can comprise mobile grinding facilities. These mobile mixing facilities 2*a* can further comprise blades, mobile facilities with a duvet effect, turbines and/or blades, with these types of mobile facilities being respectively shown in the FIGS. 5A, 5B and 5C. In the embodiments of FIGS. 3 and 4, the mobile mixing facilities 2*a* comprise turbines.

Moreover, in each one of these two examples, the device 1 further comprises second means of agitation 2*b* in the form of means for generating ultrasonic vibrations comprising sonotrodes 2*b*.

Figure 3:
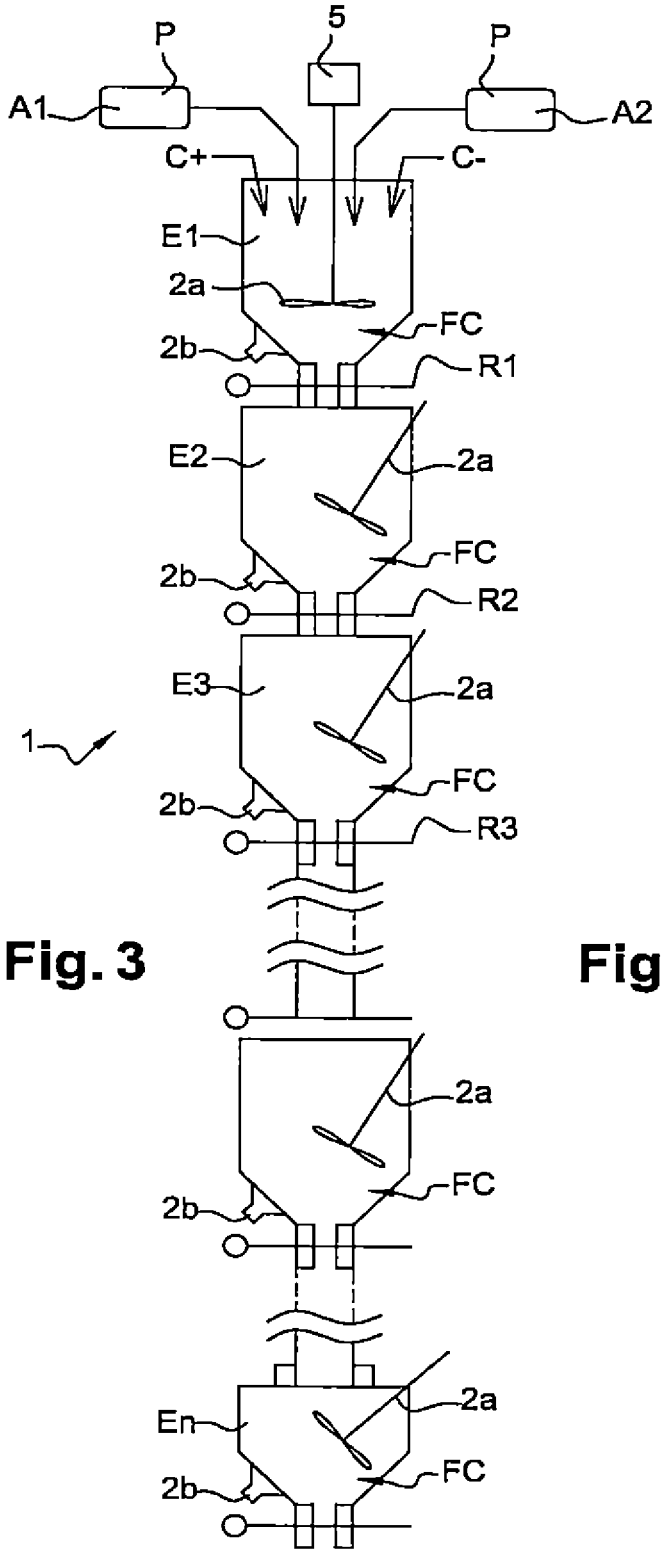
Figure 4:
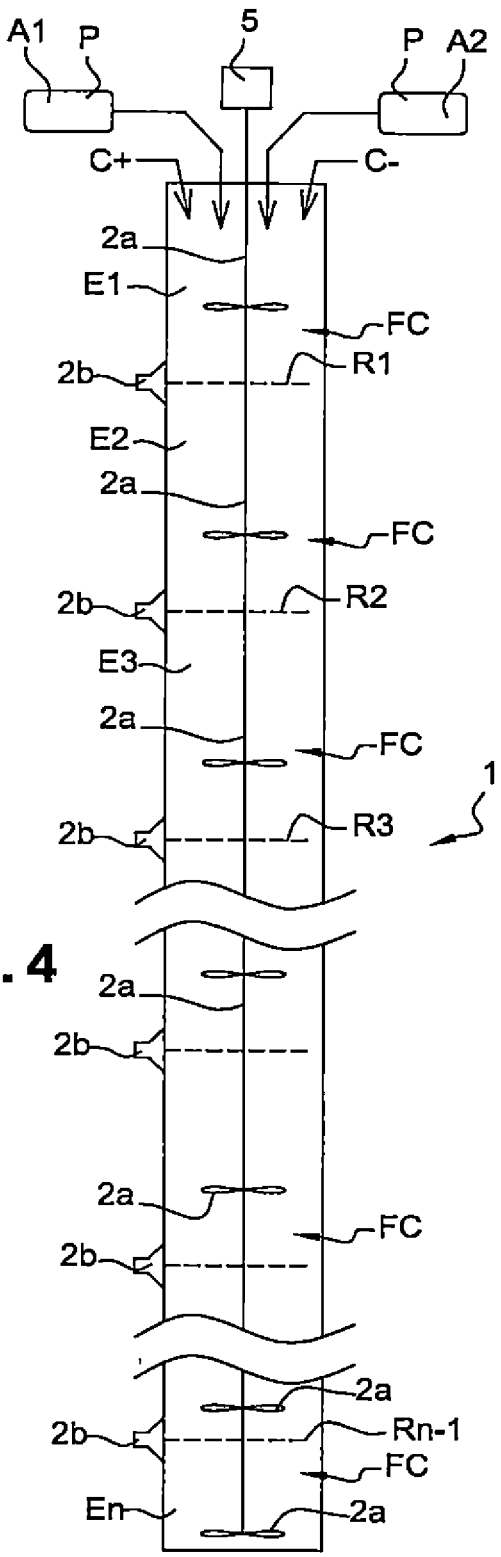
Figure 5A:
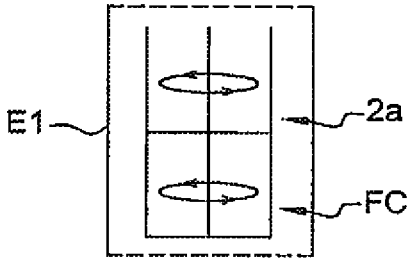
Figure 5B:
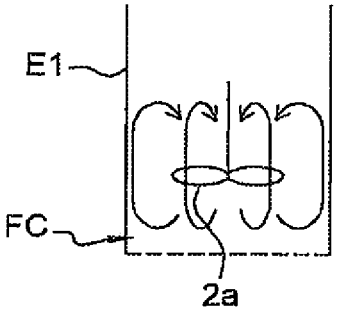
Figure 5C:
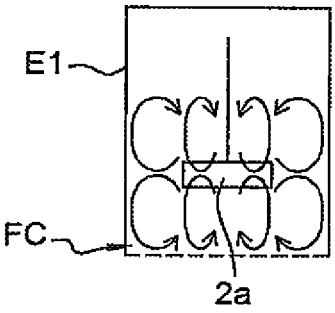

In addition, the two embodiments shown in the FIGS. 3 and 4 are differentiated by the nature of the systems for restricting the passage R1, . . . , Rn−1 used.

As such, in the embodiment of FIG. 3, the systems for restricting the passage R1, . . . , Rn−1 comprise diaphragms.

In the embodiment of FIG. 4, the systems for restricting the passage R1, . . . , Rn−1 comprise screens, more precisely meshes of screens.

In these two examples, the systems for restricting the passage R1, . . . , Rn−1 have a section of passage that can be adjusted and as such arranged in such a way that their sections of passage are ranked from the largest to the finest in the descending direction of the flow of powders P. Advantageously also, the sections of passage of these systems for restricting the passage R1, . . . , Rn−1 are less than the section of natural flow of the powders P in order to force the deagglomeration before the passage through these sections.

An example of dimensioning of a device shall now be described 1 in accordance with the invention according to the first embodiment of the invention.

For the dimensioning of the mixing chambers E1, . . . , En, it is necessary to evaluate in particular:

- the speeds of the mobile mixing facilities 2*a* in order to allow for the pulling off of the particles of powders P from the bottom of each mixing chamber E1, . . . , En,
- the mixing time of the powders,
- the flow rate of the powders P, namely the quantity of powders P that can be mixed per unit of time.

For this, the equation given by the Zwietering correlation can be used, namely:

$$N\min = \varphi \cdot \left(\frac{DT}{DA}\right)^{\alpha} \cdot g^{0.45} \cdot \frac{(\rho_P - \rho_L)^{0.45} \cdot \mu_L^{0.1} \cdot d_P^{0.2} \cdot (Ws)^{0.13}}{DA^{0.85} - \rho_L^{0.55}},$$

wherein in particular:

- Nmin represents the minimum frequency of agitation to have the pulling off of the particles of powders P,
- DT represents the diameter of the mobile mixing facility 2*a*,
- DA represents the diameter of the mixing chamber E1, . . . , En,
- $\rho_P$ represents the density of the powder P,
- $\rho_L$ represents the density of the cryogenic fluid FC,
- $\mu_L$ represents the viscosity of the cryogenic fluid FC,
- $d_P$ represents the diameter of the particles of powder P,
- Ws represents the mass ratio between the solid phase and the liquefied phase, in percentages.

Moreover, the following equations can also be used:

$$Q_p = 0.73 \cdot ND^3,\ Q_c = 2 \cdot Q_p,\ tm = 3 \cdot tc,\ tc = V/Qc \text{ and } P = N_p \cdot \rho \cdot N^3 \cdot d^5,$$

wherein in particular:

- $Q_p$ represents the pumping flow rate,
- $Q_c$ represents the circulation flow rate,
- N represents the speed of agitation,
- d represents the diameter of the mobile mixing facility,
- P represents the agitation power.

The table 1 hereinafter as such gives the dimensioning obtained of a device 1 according to the invention in order to obtain 1 kg/h of shred.

TABLE 1

| Characteristics of the device 1 | Values |
|---|---|
| Volume of a mixing chamber E1, . . . , En | 100 mL |
| Diameter of a mixing chamber E1, . . . , En | 10 cm |
| Content of powder P in the suspension | 10% |
| Rotation frequency of the mobile mixing facilities | 8 $s^{-1}$ |
| Diameter of a mobile mixing facility | 4 cm |
| Pumping flow rate | $3.7.10^{-4}$ $m^3/s$ |
| Circulation flow rate | $7.5.10^{-4}$ $m^3/s$ |
| Mixing time (tm) for a chamber with a 10% load (A) | ~0.40 s |
| Mixing capacity | ~0.9 kg/h |
| Number of mixing chambers | 4 |
| Agitation power | 105 $W/m^3$ |

Figure 6:
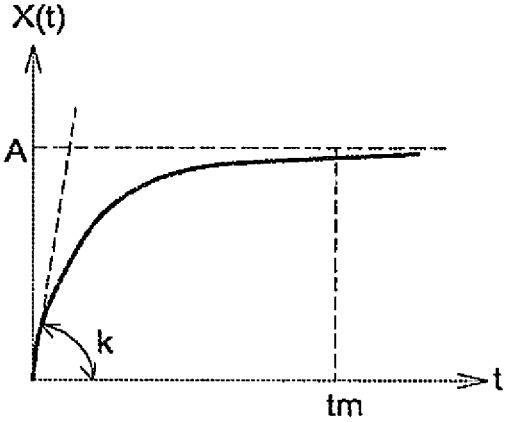

The device 1 obtained then has a mixing response shown by the graph of FIG. 6, showing the change X of the mixture as a function of time t, which is the curve X(t)=A·[1−exp(−k·t)], k being a given coefficient, A a mixing load, and tm the mixing time.

Advantageously, the putting into series of n mixing chambers E1, . . . , En having a unit volume Vn such that the global volume V of the mixing chambers E1, etc., is such that V=n·Vn.

Figure 7:
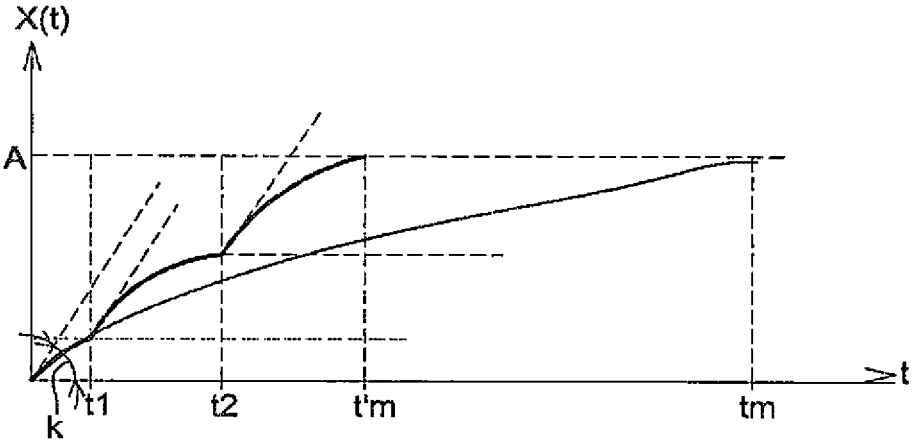

In this case indeed, the global mixing time t'm is less than the mixing time tm for the volume V. The difference is as great between these mixing times as n is large, as shown by the graph of FIG. 7, showing the change X of the mixture as a function of time t, similarly to FIG. 6, with the times t1 and t2 of the first and second chambers and the times t'm and tm.

Figure 8:
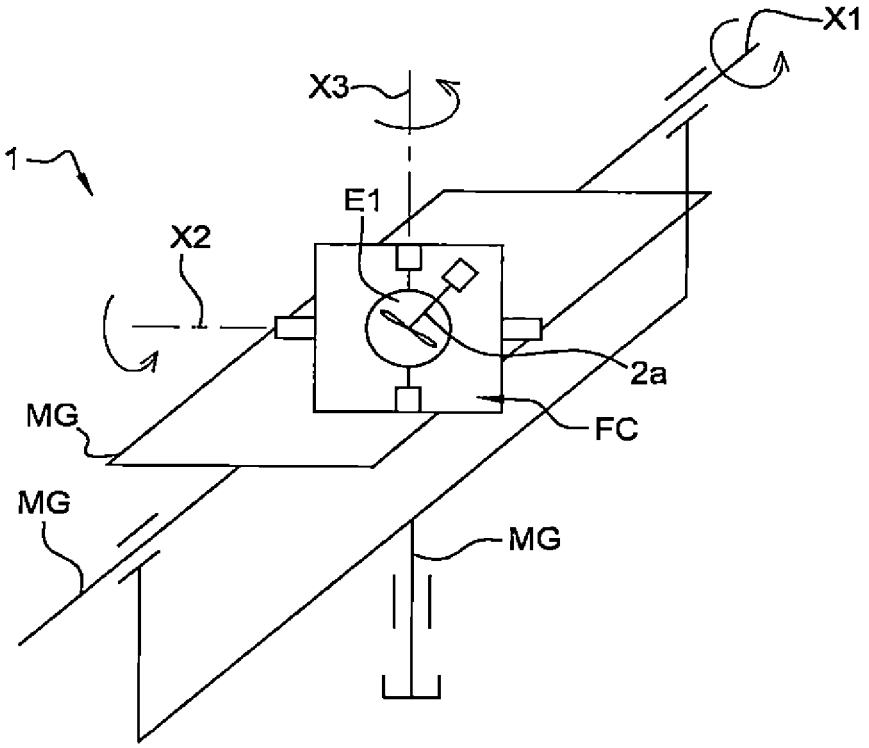
FIG. 8 shows a diagram illustrating a device for mixing powders by a cryogenic fluid according to a second embodiment of the invention, and FIGS. 9, 10 and 11 respectively show photographs of a first type of powders before mixing, of a second type of powders before mixing, and of the mixture obtained from the first and second types of powders after mixing through a device and a method in accordance with the invention.

Also shown, in reference to FIG. 8, a diagram showing a device 1 for mixing powders P by a cryogenic fluid according to a second embodiment of the invention.

In this example, the device 1 comprises a single mixing chamber E1 and means for mixing MG of this mixing chamber E1 according to a movement of the gyroscopic type.

More precisely, these means of mixing MG are according to a movement of the gyroscopic type, or close to being so, allowing for the rotation of the mixing chamber E1 according to the three axes X1, X2 and X3 of three-dimensional metrology. This type of agitation by gyroscopic movement favours the mixture of powders P when they have high densities compared to the density of the phase of the cryogenic fluid FC located in the mixing chamber E1.

In addition, the mixing chamber E1 comprises means for agitation 2*a*, for example in the form of turbines.

The effectiveness of the mixture that can be achieved through this invention can be characterised by the homogeneity of the granular medium obtained after mixing. As such, FIGS. 9, 10 and 11 respectively show photographs of a first type of powders before mixing, of a second type of powders before mixing, and of the mixture obtained from the first and second types of powders after mixing through a device 1 and a method in accordance with the invention.

Figure 9:
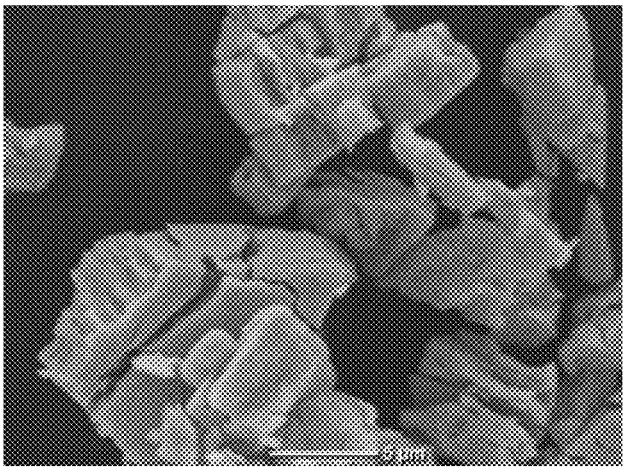
Figure 10:
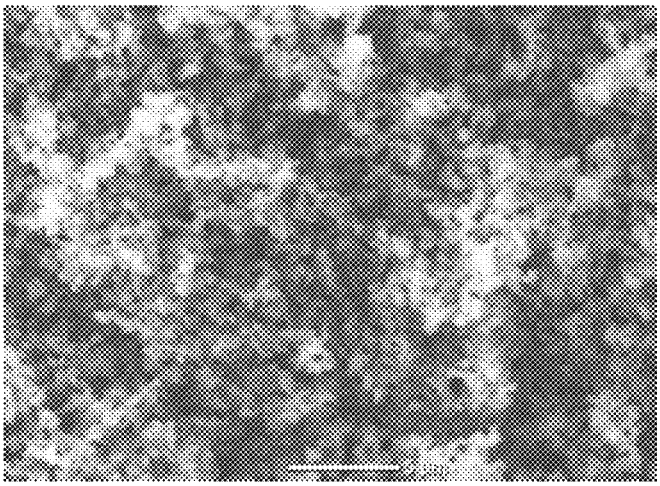
Figure 11:
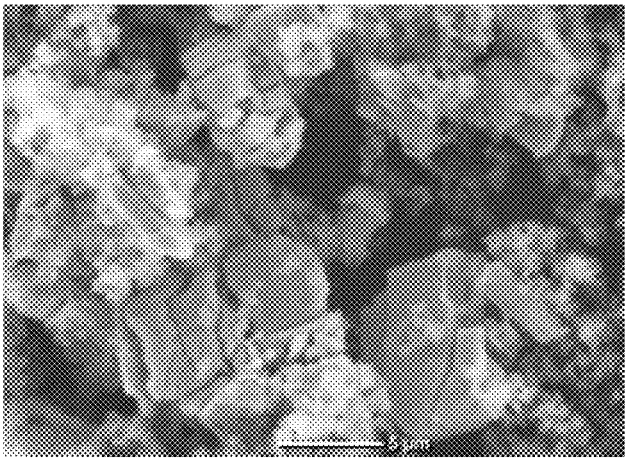

More precisely, FIG. 9 shows aggregates of cerium dioxide powders $CeO_2$, FIG. 10 shows aggregates of alumina powders $Al_2O_3$, and FIG. 11 shows the mixture of these powders obtained with a mixing time of about 30 s and the use of a single mixing chamber containing liquid nitrogen as the mixing cryogenic fluid.

It is then observed, despite a short mixing time (30 s) of the aforementioned powders and implemented in an equimassic manner (equal proportion in mass of the two powders), good homogeneity of the granular medium after mixing, as shown in FIG. 11, with a size of the aggregates close to that of the powders to be mixed, here with a dimension close to 5 μm.

Of course, the invention is not limited to the embodiments that have just been described. Various modifications can be made thereto by those skilled in the art.

The invention claimed is:

1. A device for mixing powders by a cryogenic fluid, comprising:

a plurality of mixing chambers, each mixing chamber comprising an agitator and a cryogenic fluid, wherein the mixing chambers are arranged successively in series one after the other;

a plurality of supplying chambers configured to introduce the powders into at least a first mixing chamber;

a plurality of restricting systems, each restricting system being located between two successive mixing chambers, wherein each restricting system is configured to constrain the distribution of powders from one mixing chamber to the next, and wherein each restricting system is configured to adjust the flow of the powders through each successive mixing chamber; and an electrostatic charge system for electrostatically charging the powders intended to be introduced into the mixing chambers.

2. The device as claimed in claim 1, wherein the cryogenic fluid is liquefied nitrogen.

3. A device for mixing powders by a cryogenic fluid, comprising:

a plurality of mixing chambers, each mixing chamber comprising an agitator, wherein each mixing chamber is configured to accept a cryogenic fluid, wherein the mixing chambers are arranged successively in series one after the other;

a plurality of supplying chambers configured to introduce the powders into at least a first mixing chamber;

a plurality of restricting systems, each restricting system located between two successive mixing chambers, wherein each restricting system is configured to constrain the distribution of powders from one mixing chamber to the next, and wherein each restricting system is configured to adjust the flow of the powders through each successive mixing chambers; and an electrostatic charge system for electrostatically charging the powders intended to be introduced into the mixing chambers.

4. The device according to claim 3, wherein the cryogenic fluid comprises a liquified gas.

5. The device as claimed in claim 3, wherein each agitator comprises mobile mixing devices.

6. The device according to claim 5, wherein the mobile mixing devices comprise mobile grinding facilities.

7. The device as claimed in claim 3, wherein each agitator comprises a device capable of generating vibrations.

8. The device as claimed in claim 3, wherein the restricting systems comprise screens.

9. The device as claimed in claim 3, wherein the restricting systems comprise diaphragms.

10. The device as claimed in claim 3, wherein the restricting systems progressively restrict the flow of the powders through the plurality of mixing chambers such that a section of passage of an (n−1)th restricting system is configured to pass powder particles that are larger or at a greater rate than the powder particles passed by an nth restricting system.

11. The device as claimed in claim 3, wherein a section of the restricting systems is less than a section length necessary for the powders to agglomerate.

12. The device as claimed in claim 3, wherein the plurality of mixing chambers and the plurality of the restricting systems are arranged along the same vertical direction in such a way as to allow for a flow of powders under the effect of gravity.

13. The device according to claim 3, wherein a portion of the powders is put into contact with a portion of the electrostatic charge system in order to be positively electrostatically charged and wherein the other portion of the powders is put into contact with the other portion of the electrostatic charge system in order to be negatively electrostatically charged, in order to allow for a differentiated local agglomeration.

14. The device as claimed in claim 3, wherein the supplying chambers comprise hoppers with an adjustable supply and/or metering systems.

15. The device as claimed in claim 3, wherein each agitator further comprises a gyroscopic agitator.

16. The device as claimed in claim 3, wherein each mixing chamber further comprises a second means of agitation in the form of a device capable of producing ultrasonic vibrations further comprising sonotrodes.

17. The device as claimed in claim 3, wherein each agitator is configured to create a suspension comprising the powders and the cryogenic fluid.

18. A method for mixing powders by a cryogenic fluid, employing the device of claim 3, comprising the following steps:

a) introducing powders intended to be mixed into the mixing chambers through one or more of the supplying chambers, b) mixing the powders in the mixing chambers to form a suspension of the powders in a cryogenic fluid and, c) obtaining a mixture formed from the powders.

19. The method according to claim 18, further comprising during the first step a), electrostatically charging the powders with positive or negative charges in order to favor differentiated local agglomeration.

20. The method according to claim 18, comprising the step of progressively restraining the passage of the flow of the powders through the mixing chambers through the restricting systems with a decreasing section of passage according to the flow of the powders.

21. The method according to claim 18, wherein the powders to be mixed are actinide powders.

* * * * *